United States Patent [19]

Anderson

[11] Patent Number: 4,915,385

[45] **Date of Patent: * Apr. 10, 1990**

[54] GOLF CLUB

[76] Inventor: Donald A. Anderson, 19281 Tobago La., Huntington Beach, Calif. 92646

[ * ] Notice: The portion of the term of this patent subsequent to Aug. 9, 2005 has been disclaimed.

[21] Appl. No.: 191,574

[22] Filed: May 9, 1988

Related U.S. Application Data

[63] Continuation of Ser. No. 7,097, Jan. 27, 1987, Pat. No. 4,762,324.

[51] Int. Cl.[4] ..... A63B 53/04

[52] U.S. Cl. ..... 273/164; 273/171

[58] Field of Search ..... 273/164, 171, 167 F, 273/167 D, 169, 170, 172, 183 D

[56] References Cited

U.S. PATENT DOCUMENTS

| | | | |
|---|---|---|---|
| D. 256,262 | 8/1980 | Benson | 273/164 X |
| 2,517,245 | 8/1970 | Scott | 273/171 |
| 3,333,854 | 8/1967 | White | 273/164 |
| 3,408,074 | 10/1968 | Antonious | 273/164 |
| 3,966,210 | 6/1976 | Rozmus | 273/169 |
| 4,693,478 | 9/1987 | Long | 273/164 |
| 4,762,324 | 8/1988 | Anderson | 273/171 X |

*Primary Examiner*—George J. Marlo

*Attorney, Agent, or Firm*—William W. Haefliger

[57] ABSTRACT

A golf putter has a head defining a ball striking front face, a bottom surface, a top surface, a rear surface, a heel and a toe; and includes:

(a) the head top surface having first, second and third regions respectively near the toe, mid-extent of the head and heel, (b) the first and third regions having two recess respectively sunk downwardly therein, (c) and metallic weights received downwardly in such recesses, the outlines of said recesses being visible from above said top surface.

The third region may define a recess in which a forward marker or markers and a virtual ball section, are located, the marker or markers and virtual ball section located to be downwardly visible.

6 Claims, 5 Drawing Sheets

GOLF CLUB

BACKGROUND OF THE INVENTION

This is a continuation of application Ser. No. 007,097 filed Jan. 27, 1987, now U.S. Pat. No. 4,762,324.

This invention relates generally to golf clubs, and more particularly to club head constructions leading to greater accuracy, i.e. ball direction control, during golfing.

There is clearly continuing need for such greater accuracy, particularly with respect to putting, and also golfing irons.

SUMMARY OF THE INVENTION

It is a major object of the invention to provide improved putter and iron constructions enhancing such accuracy. With respect to putter structure, the invention contemplates the provision of weights in recesses in the head which are visible from above during putting-,and in relation to head recess and marker stuctures between such visible weight Thus, the head may include:

(a) a top surface having first, second and third regions respectively near the toe, mid-extent of the head, and heel, (b) the first and third regions having two recesses respectively sunk downwardly therein, (c) and metallic weights received downwardly in such recesses, the outlines of said recesses being visible from above the top surface, to visibly assist putting.

The head metal is typicallyless dense than that of the weights; and the head typically defines a ledge proximate said second region and extending generally lower portions of said weights and inlucding a main marker on the ledge directed toward the front face of the head. The main marker is typically located at the mid-point between the weight recesses; and additional forward indicating markers may be distributed between the main marker and one recess, and between the main marker and the other recess, arranged in the form of a delineated golf ball section.

The latter section, of golf ball width, is directly forward of the main marker, to further visibly assist the golfer in putting, since the delineated ball moves with the head, directly toward the ball to be stroked. The putter shaft axis typically intersects the head closer to the weight at the heel than to the weight at the toe to assure ease of downward viewing of both markers; while addressing the ball; and more added weight may be concentrated at the toe to compensate inertially for the shaft axis location closer to the weight at the heel.

A similar golfing iron construction is also provided, as will appear.

These and other objects and advantages of the invention, as well as the details of an illustrative embodiment, will be more fully understood from the following specification and drawings, in which:

DRAWING DESCRIPTION

DETAILED DESCRIPTION

Figure 1:
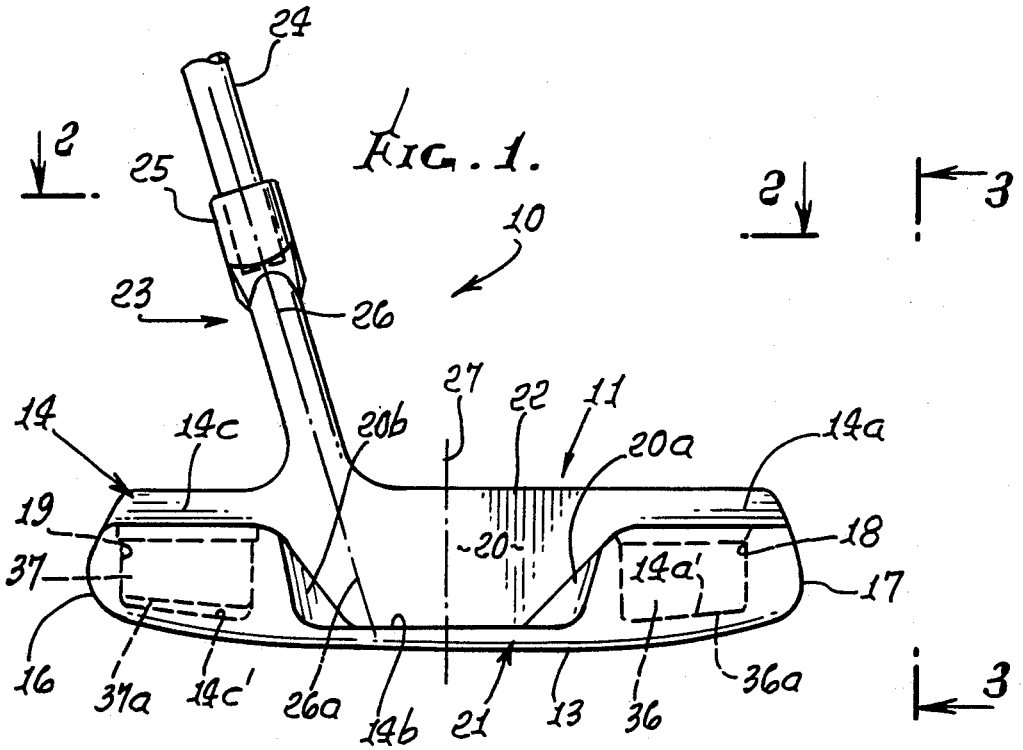
FIG. 1 is an elevation showing the rear side of a golf putter emobdying the invention.

In FIG. 1, a golf putter 10 has a head 11 defining a ball striking front face 12, a bottom surface 13, a top surface 14 including three (first, second and third) regions 14*a* to 14*c*, a rear surface 15 including two rear surface portions 15*a* and 15*c*, a heel at 16 and a toe 17, the head being elongated between the latter. The bottom surface is downwardly shallowly convex between the heel and toe; and the head defines first and second recesses 18 and 19 respectively sunk donwardly into said first and third regions 14*a* and 14*c* to terminate at locations 14*a*′ and 14*c*′ spaced above the bottom surface 13. A third and main recess 20 is sunk or formed downwardly in the head at its middle portion and between the loci of the recesses 18 and 19, so that the top surface 14*b* at the bottom of recess 20 is approximately at the bottom levels 14*a*′ and 14*c*′. Downwardly tapered recess side surfaces 20*a* and 20*b* join surfaces 14*a* to 14*b*. A thin ledge 21 is formed between surfaces 14*b* and 13.

The head defines a forward upright wall 22 that extends longitudinally between and forwardly of the first and second regions 14*a* and 14*c*, and above their levels. Wall 22 also extends directly forwardly of the recess 20. A hosel 23 is integral with the wall 22, at the top thereof, and a shaft 24 is supported by the hosel at 25, to define a shaft axis 26 that intersects or extends into the head at 26*a*, closer to region 14*c* than to 14*a*, i.e. offset from central vertical and forward plane 27. Therefore, markers 30–34 on lowered ledge 21 are clearly visible forwardly of the hosel and shaft, and the hosel and shaft do not physically interfere with the forwardly directed visibility and direction indicating characteristics of the markers and weights The markers include a main central marker 30 such as an arrow, and markers of progressively lesser length at 31 and 32, at 33 and 34, as shown. The rear terminii of the markers lie on and define a semi-circle 35 (corresponding to half of a golf ball) on the ledge, whereby the center of the club at the center of the "ball" defined by marker 30 is clearly delineated, so that a golfer as he putts appears to be moving a "ball" directionally and controlling it before the head strikes the real golf ball 40 and centrally toward the latter, for greater putting accuracy. Note that the width of recess 20 is approximately the diameter of apparent "ball" 35, to enhance this control effect.

The above effect is even further enhanced by the top visibility of two weights 36 and 37 in the two recesses 18 and 19, at diametrically opposite sides of and equally distant from the "apparent" half-ball 35. This occurs due to the fact that the weight recesses are sunk downwardly from the regions 14*a* and 14*c*. Such weights provide a high moment of inertia against inadvertent twisting of the shaft, so as to increase the accuracy of putting stroking of the ball 40. Note that the tops of the weights are substantially flush with the top surfaces of the regions 14*a* and 14*c*. The weights may typically consist of copper, whereas the head itself may consist of aluminum or aluminum alloy. The weights may be pressed into place, or retained by suitable adhesive. They appear rectangular in FIG. 2. The total weight of the weight 36 may exceed that of 37, as by making the latter shallower (see bottom surface level 37*a* in FIG. 1 elevated relative to bottom surface level 36*a*), thereby to inertially compensate for the position of shaft axis 26 closer to weight 37 than to weight 36. Front face 12 in FIG. 3 is tilted rearwardly relative to vertical at about 4°, and is defined by wall 22.

Figure 3:
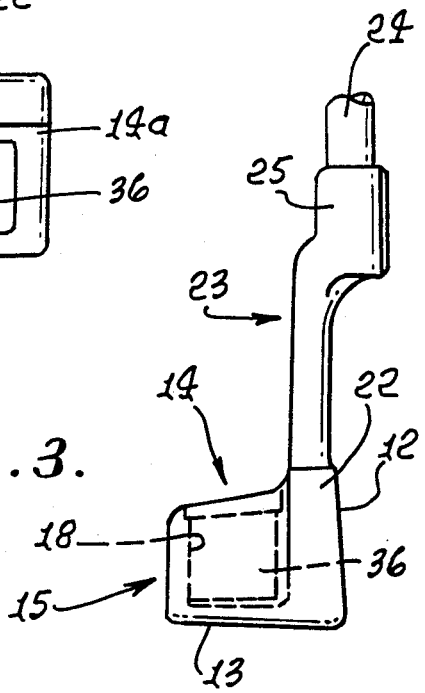
FIG. 3 is an end view on lines 3—3 of FIG. 1.
Figure 4:
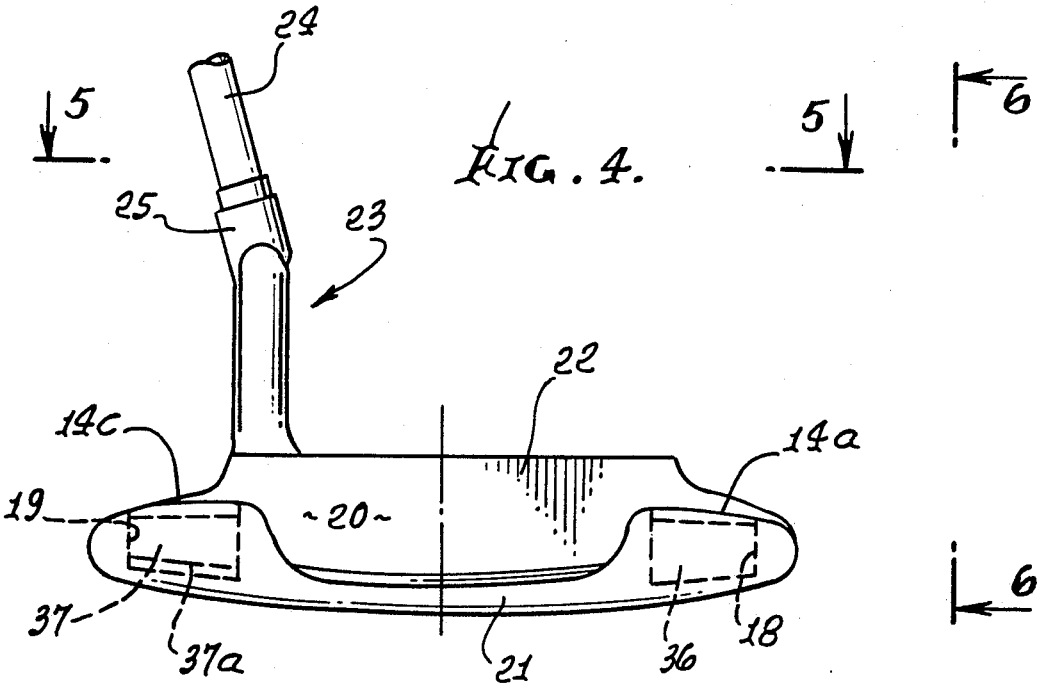
FIG. 4 is an elevation showing the rear side of a first modified golf putter embodying the invention.
Figure 5:
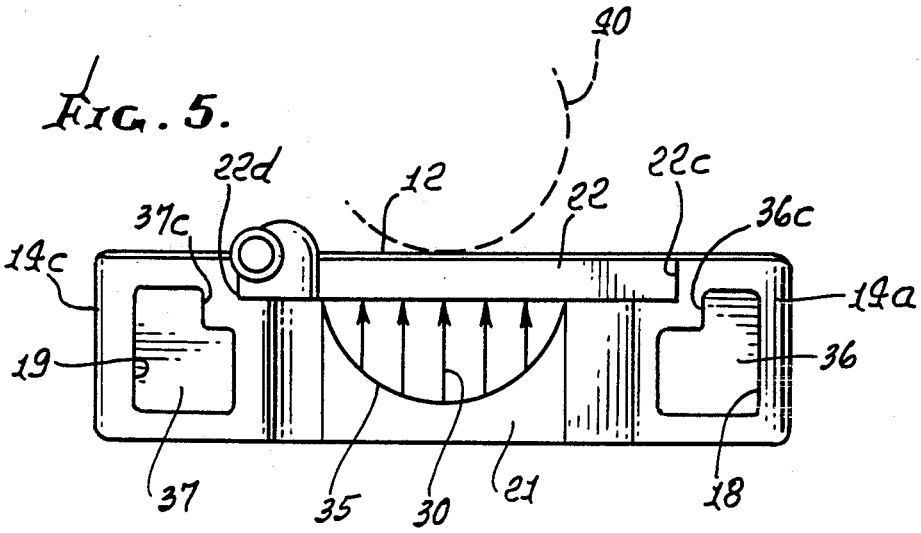
FIG. 5 is a plan view on lines 5—5 of FIG. 4.
Figure 6:
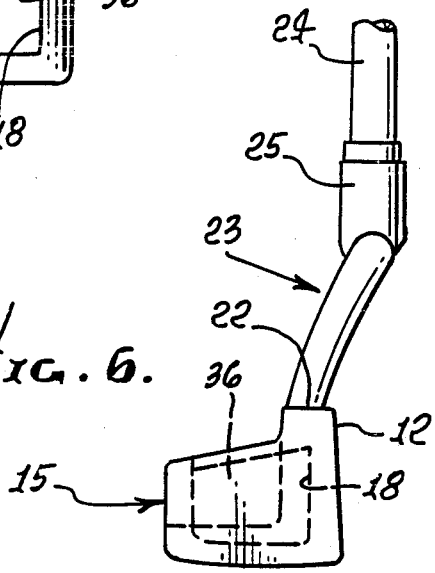
FIG. 6 is an end view on lines 6—6 of FIG. 4.

FIGS. 4–6 show a similar but somewhat modified putter head, corresponding parts bearing the same numbers as in FIGS. 1 3. The weights 36 and 37 have L-shape, in horizontal cross section, and are visible from above the head. The corners 36*c* and 37*c* of the weights face the corners 22*c* and 22*d* of the plate 22. Also, the recesses 18 and 19 have the same shapes as the weights. Hosel 23 extends vertically downwardly in FIG. 4, and rearwardly in FIG. 6, as shown.

Figure 2:
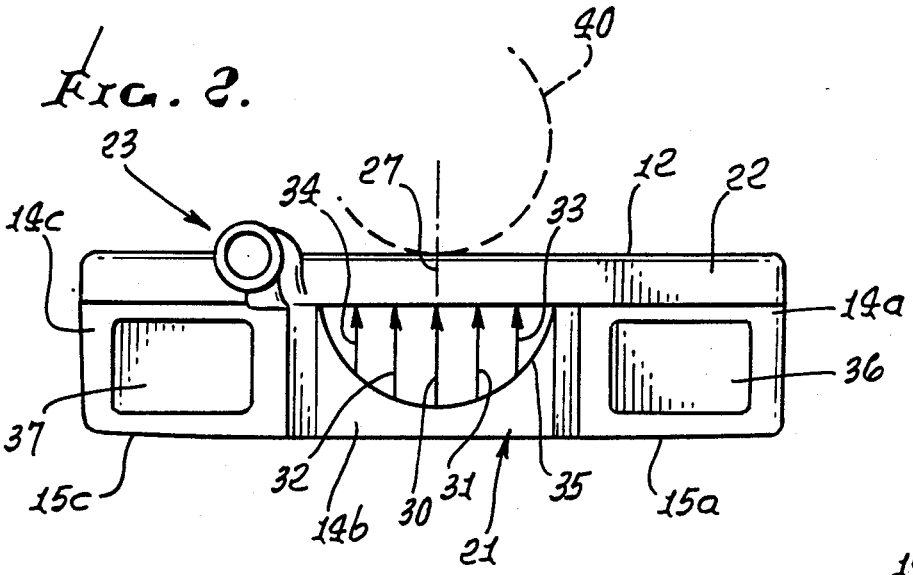
FIG. 2 is a plan view on lines 2—2 of FIG. 1.
Figure 7:
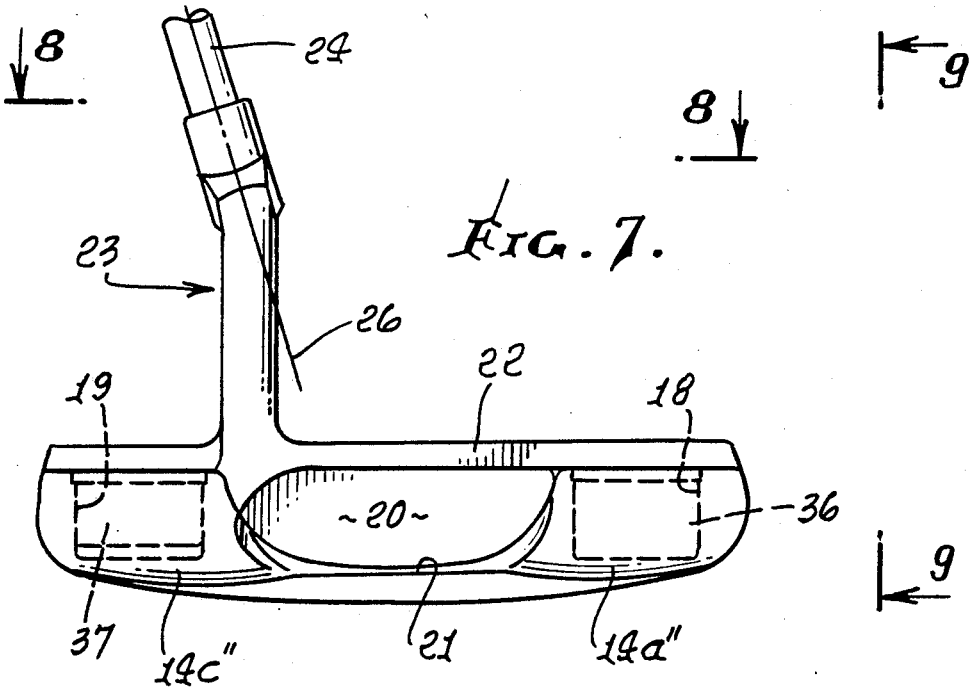
FIG. 7 is an elevation showing the rear side of a second modified golf putter embodying the invention.
Figure 8:
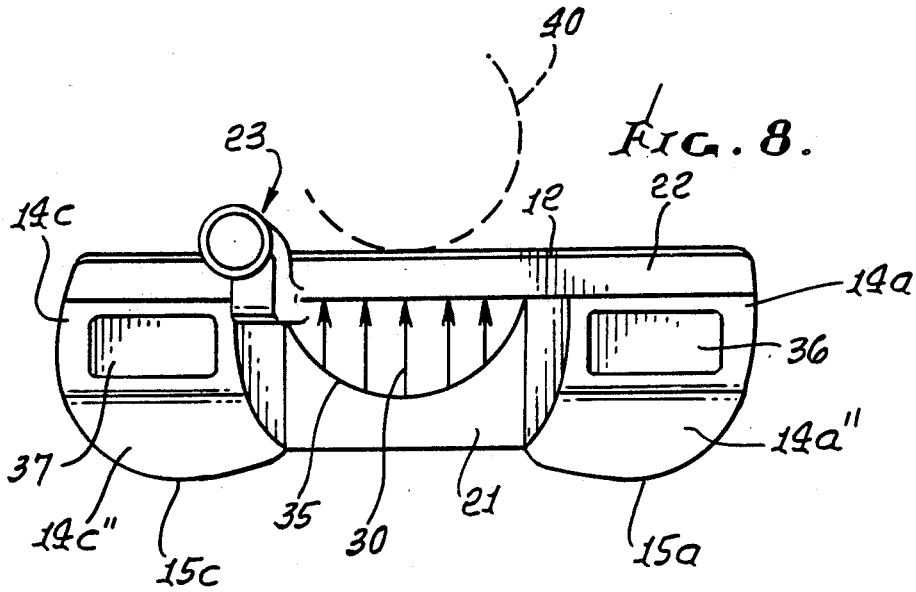
FIG. 8 is a plan view on lines 8—8 of FIG. 7.
Figure 9:
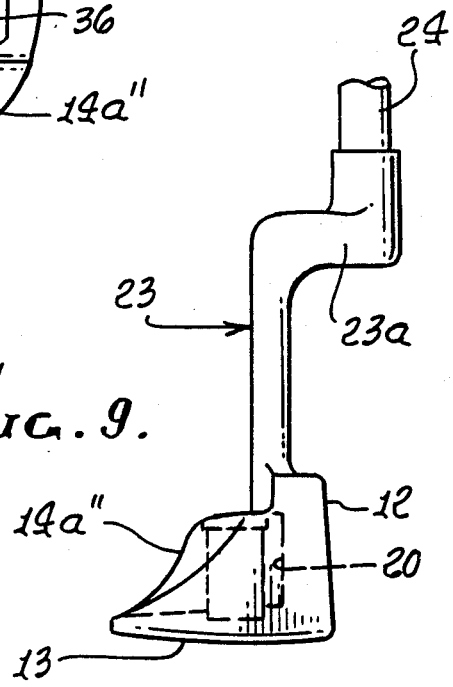
FIG. 9 is an end view on lines 9—9 of FIG. 7.

FIGS. 7–9 show a similar but somewhat modified putter head, corresponding parts bearing the same numbers as in FIGS. 1–3. The weights 36 and 37, and recesses 18 and 19 are closer to the front plate 22 than to the rear surfaces 15*a* and 15*c*, the latter being rearwardly convex; also, the top surfaces 14*a* and 14*c* taper rearwardly and downwardly, at 14*a*″ and 14*c*″. Hosel 23 extends vertically downwardly to plate 22, in both FIGS. 7 and 9, and the shaft is offset from the hosel, as by dog leg 23*a*.

Figure 10:
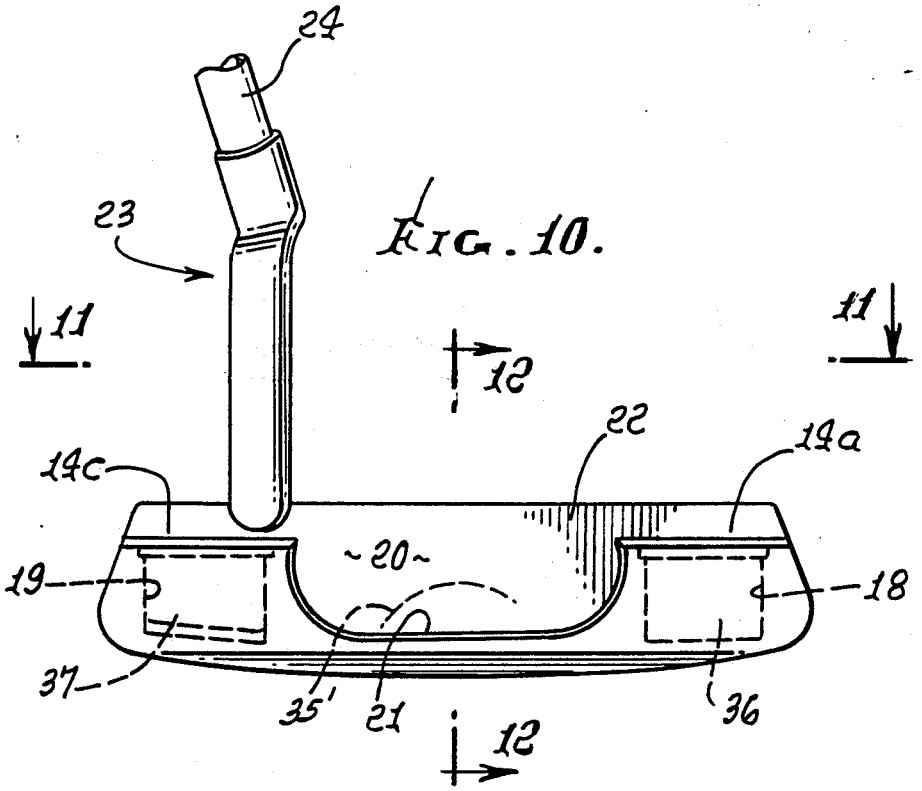
FIG. 10 is an elevation showing the rear side of a fourth modified golf putter embodying the invention.
Figure 11:
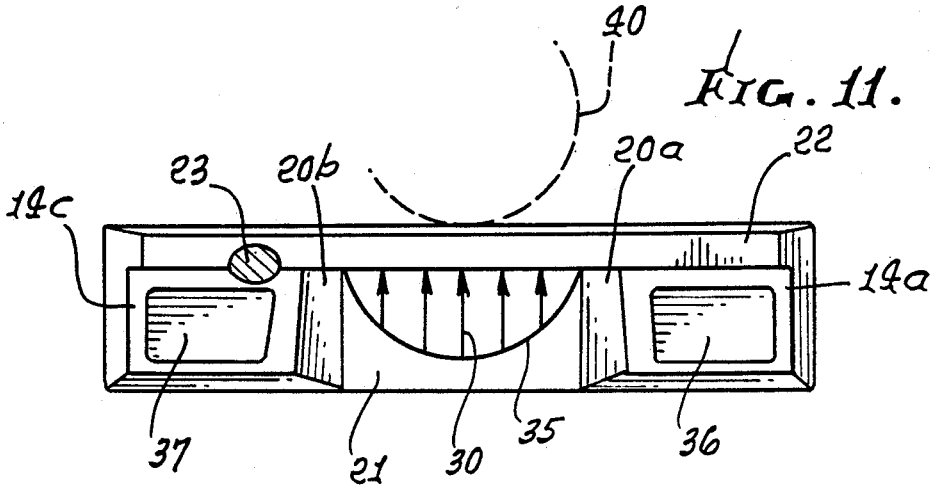
FIG. 11 is a top plan view on lines 11—11 of FIG. 10.
Figure 12:
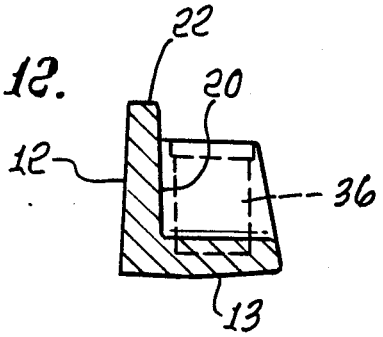
FIG. 12 is a section taken on lines 12—12 of FIG. 10.

In FIGS. 10–12, the modified putter has corresponding parts numbered the same as in FIGS. 1–3. Surfaces 20*a* and 20*b* are upwardly and inwardly concave; and front plate 22 has a length about the same as the maximum length "L" of the head.

Figure 13:
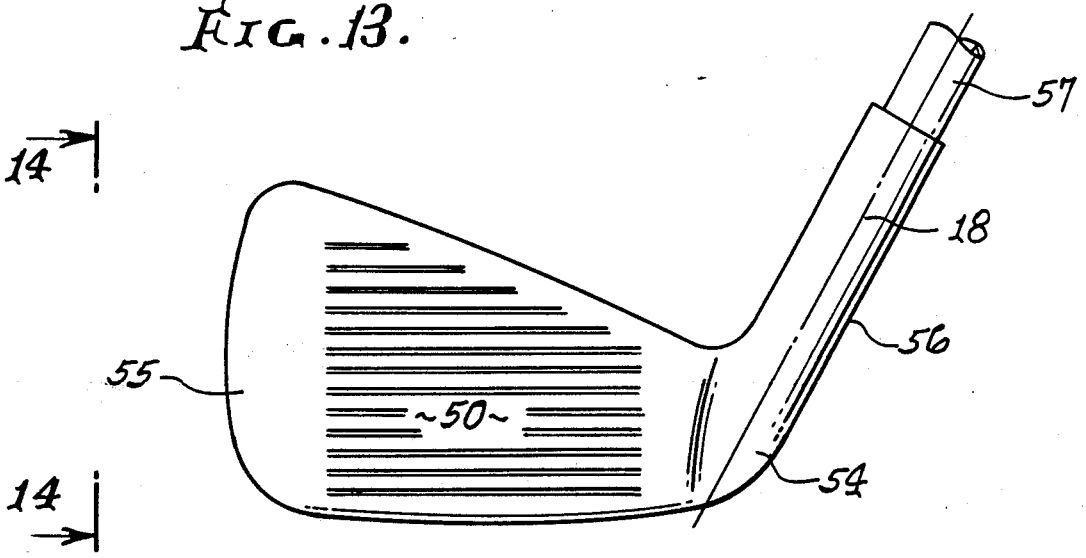
FIG. 13 is a front elevation showing a golfing iron embodying the invention.
Figure 14:
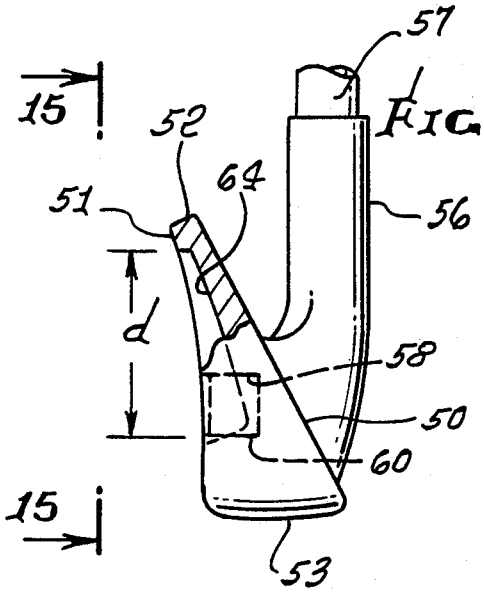
FIG. 14 is an end elevation on lines 14—14 of FIG. 13.
Figure 15:
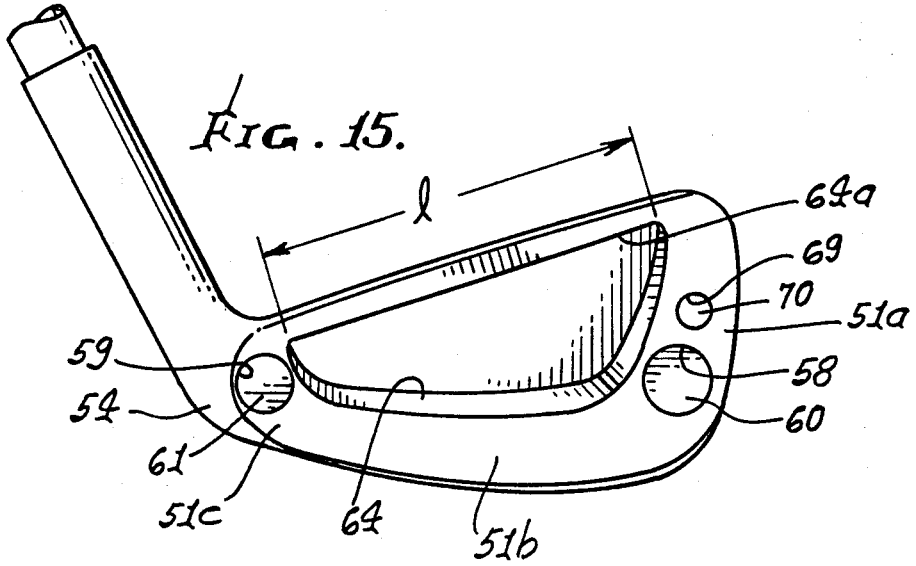
FIG. 15 is a rear elevation on lines 15—15 of FIG. 14.

In FIGS. 13–15, the invention is applied to a golfing iron, having a front face 50, rear face 51, top 52, bottom 53, heel 54, toe 55, and hosel 56 to which a shaft 57 is connected. Rear surface or face 51 has first, second and third regions 51*a*, 51*b* and 51*c* forming a U-shape, and respectively near the toe, mid-extent, and heel of the head. The first and third regions have two recesses 58 and 59 sunk forwardly therein; and metallic weights 60 and 61 are pressed into the recesses, or adhered therein as by suitable adhesive. The weights are visible from the rear side of the head, and may consist of copper, whereas the head consists of steel. Thus, the weight metal is substantially more dense than the head metal. Copper alloy, as with silver, is usable.

The head defines a third recess 64 sunk in the rear surface in a forward direction, and located between the weights and their recesses; also, the third recess 64 extends to line 64*a* proximate the top surface 52. It has a length between head and toe which is greater than 50% of the length of the head, and a maximum depth "d" greater than 50% of the maximum vertical dimension of the head between top and bottom 52 and 53. The weight and head construction serve the same purposes as in FIGS. 1–12. Note also that the shaft axis 18 extends to the heel 54. The weight of weight 60 may be substantially greater than that of weight 61, to compensate inertially (i.e. in a head twist resisting sense) for the shaft axis location relative to the weights 60 and 61.

Another weight recess 69 is formed in the region 51*a*, to receive an additional copper weight 70 to provide the added inertial compensating weight referred to.

The radius of circle 35 is 21 millimeters, i.e. the same as that of a standard golf ball.

In FIG. 10, the ledge 21 within circular section perimeter 35 may be domed upwardly (see broken line section 35′) and pocked to represent the top of a "virtual" golf ball.

We claim:

1. In a golf club having a head defining a ball striking front face, a bottom surface, a top surface, a rear surface, a heel and a toe, the improvement comprising:

(a) the top surface having first, second and third regions respectively near the toe, mid-extent of the head and heel, (b) each of the first and third regions having a recess sunk downwardly therein, (c) and metallic weights received downwardly in said recesses, each recess intersecting the corresponding region top surface so that the outlines of said recesses and weights are substantially polygon shaped, in horizontal cross section, with said outlines visible from above said top surface, the recesses having bottom walls everywhere spaced above the bottom surface of the head, (d) the head defining a ledge proximate said second region, the ledge having a top surface extending generally at the levels of the lowermost portions of said weights, and including a main marker on the ledge directed toward the front face of the head, said marker being located at the mid-point between said recesses, the head being vertically open above the ledge top surface to enable downward viewing of the main marker, (e) and the head defining a forward upright wall that extends between and forwardly of said first and third regions and above their levels, the club having a hosel intergral with said wall at a location above the top levels of said first and third regions.

2. The improvement of claim 1 wherein the club is a putter which has a shaft connected to the hosel and defining an axis which intersects the head substantially closer to said third region than to said first region.

3. The improvement of claim 1 wherein the head has at least one of the following:

(i) the weights have L-shape, in horizontal cross section, (ii) the weights are everywhere closer to said front face than to said rear surface, (iii) the head top surface tapers rearwardly and downwardly toward said bottom surface, rearwardly of said weights.

4. The improvement of claim 1 wherein the weights are metallic and have the same outlines.

5. The improvement of claim 1 wherein the weight in said first recess is substantially heavier than the weight in said third recess of the head.

6. The improvement of claim 1 wherein said ledge is upwardly domed to represent a section of the top of a golf ball.

* * * * *